US008523170B2

(12) United States Patent
Nishida et al.

(10) Patent No.: US 8,523,170 B2
(45) Date of Patent: Sep. 3, 2013

(54) SHEET FEEDER AND IMAGE FORMING APPARATUS INCORPORATING SAME

(75) Inventors: Hajime Nishida, Kanagawa (JP); Manabu Nonaka, Kanagawa (JP); Yoshikuni Ishikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 84 days.

(21) Appl. No.: 13/331,797

(22) Filed: Dec. 20, 2011

(65) Prior Publication Data

US 2012/0170960 A1 Jul. 5, 2012

(30) Foreign Application Priority Data

Jan. 5, 2011 (JP) ..... 2011-000382

(51) Int. Cl.
*B65H 3/04* (2006.01)
*B65H 3/18* (2006.01)

(52) U.S. Cl.
USPC ..... 271/18.1; 271/34; 271/193

(58) Field of Classification Search
USPC ..... 271/18.1, 18.2, 34, 193
See application file for complete search history.

(56) References Cited

U.S. PATENT DOCUMENTS 4,431,175 A * 2/1984 Smith ..... 271/10.08
8,342,507 B2 * 1/2013 Takahashi et al. ..... 271/18.1

FOREIGN PATENT DOCUMENTS

JP 04251041 A 9/1992
JP 05-139548 A 6/1993
JP 09272637 A * 10/1997
JP 2003-160242 A 6/2003
JP 2003237962 A 8/2003
JP 2010037047 A 2/2010

OTHER PUBLICATIONS

Abstract of JP 04-251041 published Sep. 7, 1992.
Abstract of JP 05-139548 published Jun. 8, 1993.
Abstract of JP 2010-037047 published Feb. 18, 2010.
Abstract of JP 2003-237962 published Aug. 27, 2003.
Abstract of JP 2003-160242 published Jun. 3, 2003.

* cited by examiner

*Primary Examiner* — Luis A Gonzalez
(74) *Attorney, Agent, or Firm* — Harness, Dickey & Pierce, P.L.C.

(57) ABSTRACT

A sheet feeder attracts an uppermost sheet of a sheet stack of a plurality of stacked sheets, and feeds the sheet in a sheet feeding direction. The sheet feeder includes an endless belt, a charging device, and a control device. The endless belt is made of a dielectric material, passes over upstream and downstream rollers, and is disposed above the sheet stack to face the sheet stack. The charging device applies an alternating voltage to an outer circumferential surface of the endless belt to form thereon alternating charge patterns. The control device separately controls the respective rotation states of the upstream and downstream rollers to make a sheet contact surface of the endless belt go slack in sheet attraction and make the sheet contact surface of the endless belt taut with tension into a substantially flat surface in sheet conveyance.

5 Claims, 6 Drawing Sheets

SHEET FEEDER AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2011-000382, filed on Jan. 5, 2011 in the Japanese Patent Office, the entire disclosure of which is hereby incorporated by reference herein.

FIELD OF THE INVENTION

The present invention relates to a sheet feeder and an image forming apparatus, and more particularly to a sheet feeder that separates and conveys the uppermost sheet from a stacked sheet stack using a charged endless belt, and an image forming apparatus using the sheet feeder.

BACKGROUND OF THE INVENTION

As a sheet feeder for feeding a sheet of recording media in an image forming apparatus such as an electrophotographic copier, facsimile machine, or printer, a sheet feeder employing a friction method using a pickup member including rollers and a belt made of a material having a relatively high coefficient of friction, such as rubber, has been widely employed.

The configuration employing the friction method is relatively simple. However, the pickup member is pressed against the surface of the sheet by a spring or the like to obtain a relatively strong frictional force. Further, with material having a relatively high coefficient of friction, such as rubber, the coefficient of friction of the surface thereof changes with time or environment. With this method, therefore, it is difficult to obtain reliable sheet feeding performance.

Further, with printers in particular, diversification of users has brought about use of not only a plain sheet but also recording media sheets of various features, such as a coated sheet and a label sheet. Moreover the number and types of such recording media sheets are expected to continue to increase in the future. Some of these special-purpose recording media sheets have a surface with a substantially low coefficient of friction. Further, a release portion of the label sheet, for example, is removed in some cases by the rotating roller and the pressing member in the process of frictional separation. Therefore, there are cases in which it is difficult to separate sheets using conventional frictional separation.

The sheets difficult to separate by friction, as in the above-described example, may be separated by an air suction method that generates a negative pressure area by air suction and thereby attracts and conveys a sheet. This method provides relatively reliable sheet feeding performance compared to the friction method. The method, however, produces relatively large noise in air suction, and increases the size and cost of the device, and is therefore unsuitable for an appliance used in an environment such as an office.

To address the above-described issues, sheet feeders have been proposed which include an endless dielectric belt facing the upper surface of a stacked sheet stack and moving in the sheet feeding direction a charger to apply an alternating voltage to a surface of the endless dielectric belt to form thereon alternating charge patterns and to discharge the endless dielectric belt. The sheet feeders supply electrical charge to the surface of the endless dielectric belt, and generate an attraction force from an electric field generated by the electrical charge to thereby separate the uppermost sheet from the sheet stack and move the sheet in the sheet feeding direction.

Such a background sheet feeder includes, for example, a belt and a charging device. The belt made of a dielectric material is looped around rollers and faces the upper surface of a bundle of sheets loaded on a sheet loader. The charging device forms predetermined charge patterns on a surface of the belt. The sheet feeder attracts and feeds a sheet from the upper surface of the sheet stack using the belt, a fulcrum of which is set on the downstream side of the sheet in the sheet feeding direction. The belt swings about the fulcrum such that the surface of the belt facing the sheet is substantially parallel to the surface of the sheet loader facing the surface of the belt.

Another background sheet feeder includes a pickup member facing the upper surface of a stacked sheet stack and which moves in the sheet feeding direction, and picks up and feeds a sheet from the upper surface of the sheet stack using the pickup member. The pickup member includes an endless dielectric belt. The sheet feeder further includes a member that applies an alternating voltage to a surface of the endless dielectric belt. The member serves as a charging and discharging member for forming alternating charge patterns on the surface of the endless dielectric belt and discharging the endless dielectric belt.

Still another background sheet feeder attracts and feeds a sheet from stacked sheets using electrostatic force, and includes a rotatable endless dielectric belt, an electrostatic attraction device, and a contacting and separating device. The electrostatic attraction device includes a charging device that supplies charge to the outer circumferential surface of the endless belt. The contacting and separating device separately and swingably supports predetermined positions of the electrostatic attraction device in a direction substantially perpendicular to the sheet feeding direction using a pair of swing members.

In the above-described sheet feeders, however, sufficient sheet separation performance and sheet conveyance performance are not provided in some cases, depending on the properties of the sheet. It is therefore desired to provide a sheet feeder consistently discharging superior sheet separation performance and sheet conveyance performance.

SUMMARY OF THE INVENTION

The present invention describes a novel sheet feeder. In one example, a novel sheet feeder attracts an uppermost sheet of a sheet stack of a plurality of stacked sheets and feeds the uppermost sheet in a sheet feeding direction. The sheet feeder includes an endless belt, a charging device, and a control device. The endless belt is made of a dielectric material, entrained around an upstream roller and a downstream roller and disposed above the sheet stack to face the sheet stack. The charging device is configured to apply an alternating voltage to an outer circumferential surface of the endless belt to form thereon an alternating charge pattern. The control device is configured to separately control rotation of the upstream roller and the rotation state of the downstream roller to make the endless belt go slack on a side of belt facing the sheet stack during sheet attraction and make the endless belt taut with tension on a side of the belt facing the sheet stack to form a substantially flat surface during sheet conveyance.

The above-identified sheet feeder may further include an upstream drive source and a downstream drive source. The upstream drive source may be configured to drive the upstream roller. The downstream drive source may be configured to drive the downstream roller. The control device may control the timing of driving of the upstream drive source and the downstream drive source separately during sheet attraction and sheet conveyance.

The above-identified sheet feeder may further include an upstream drive source and a downstream drive source. The upstream drive source may be configured to drive the upstream roller. The downstream drive source may be configured to drive the downstream roller. The control device may switch between forward drive and reverse drive of the upstream drive source and the downstream drive source during sheet attraction and sheet conveyance.

The above-identified sheet feeder may further include a single drive source configured to drive the upstream roller and the downstream roller. The control device may include a switching mechanism configured to switch between the upstream roller and the downstream roller as the transmission destination of rotational drive force of the drive source.

The present invention further describes a novel image forming apparatus. In one example, a novel image forming apparatus includes an image forming device configured to form an image on a sheet and the above-described sheet feeder.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
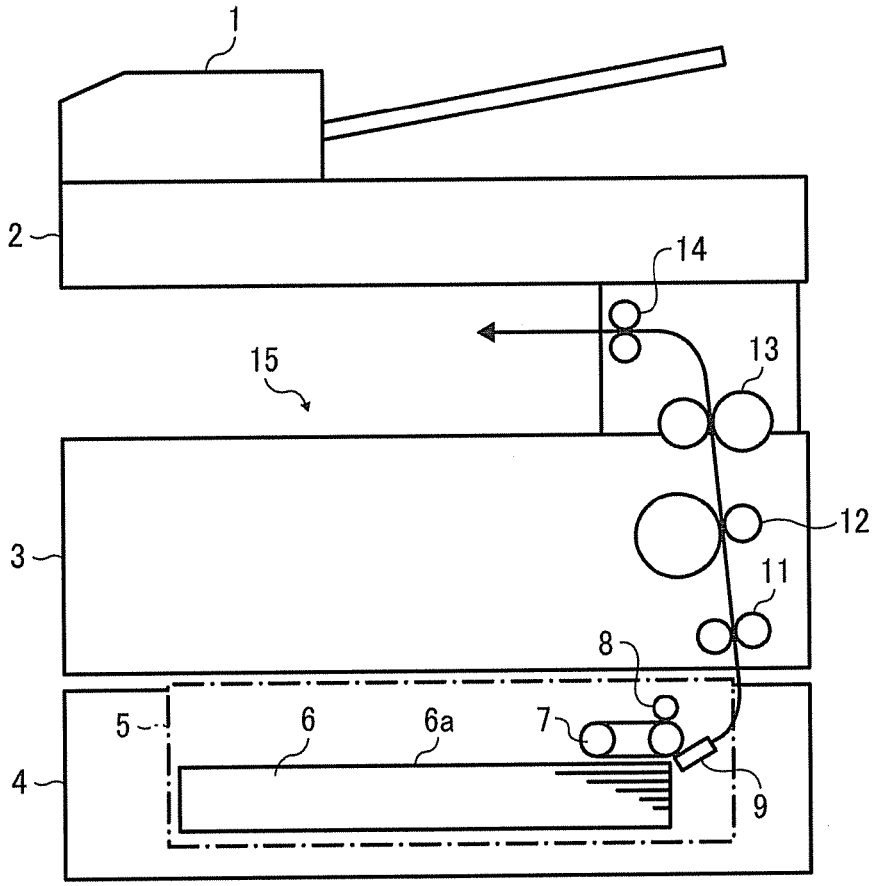
FIG. 1 is a conceptual cross-sectional view illustrating a configuration of an image forming apparatus according to a first embodiment.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, embodiments of the present invention will be described below.

A sheet feeder according to an embodiment of the present invention includes an endless belt, a voltage applying member, and a control device. The endless belt is made of a dielectric material, passes over an upstream roller and a downstream roller, and is disposed above a sheet stack of a plurality of stacked sheets to face the sheet stack. The voltage applying member applies an alternating voltage to an outer circumferential surface of the endless belt to form thereon alternating charge patterns. The sheet feeder attracts the uppermost sheet of the sheet stack, and feeds the sheet in the sheet feeding direction. The upstream roller and the downstream roller are provided with respective drive sources. The control device separately controls the respective drive sources of the upstream and downstream rollers to sag a sheet contact surface of the endless belt in sheet attraction to place the endless belt in a state suitable for the sheet attraction, and stretch the sheet contact surface of the endless belt with tension into a substantially flat surface in sheet conveyance to place the endless belt in a state suitable for the sheet conveyance. In the following description, a sheet, which serves as a recording medium, may be simply referred to as a sheet.

An image forming apparatus according to an embodiment of the present invention (hereinafter simply described as embodiment), i.e., an image forming apparatus according to a first embodiment will now be described on the basis of the drawings. FIG. 1 is a schematic cross-sectional view illustrating a configuration of the image forming apparatus according to the first embodiment. A copier 1 serving as the image forming apparatus includes a document reading unit 2, an image forming unit 3, and a sheet feeding unit 4. In the copier 1, the image forming unit 3 and the sheet feeding unit 4 are separable from each other. The sheet feeding unit 4 includes a sheet feeder 5. The sheet feeder 5 includes a sheet attracting and separating device 7, a charging roller 8, and a separating unit 9. The sheet attracting and separating device 7 is in contact with the upper surface of a bundle of sheets (hereinafter referred to as sheet stack) 6 stacked and disposed in a not-illustrated sheet feeding cassette, and attracts and separates the uppermost sheet from the stacked sheet stack 6. In the present example, the sheet attracting and separating device 7 is configured as a unit attachable to and detachable from the sheet feeding unit 4.

An uppermost sheet 6*a* corresponding to the uppermost sheet of the stacked sheet stack 6 is attracted by the sheet attracting and separating device 7, and is separated from the other sheets of the sheet stack 6 and fed by the separating unit 9. The separated and fed sheet is then transported by a registration roller pair 11. Further, a toner image formed by the image forming unit 3 is transferred onto the sheet by a transfer device 12, and is heat-fixed on the sheet material by a fixing device 13. Then, the sheet is discharged to a sheet discharge tray 15 by discharging rollers 14.

The sheet feeder according to an embodiment of the present invention described below is applicable to, as well as the above-described electrophotographic image forming apparatus, an image forming apparatus according to another method, such as an inkjet method, for example. Further, the sheet feeder according to an embodiment of the present invention is applicable to, as well as the above-described copier, a facsimile machine, a printer, or a multifunction machine having the functions of at least two of the above devices, for example. The sheet feeder according to an embodiment of the present invention may also be referred to as a sheet feeding and separating device.

Figure 2:
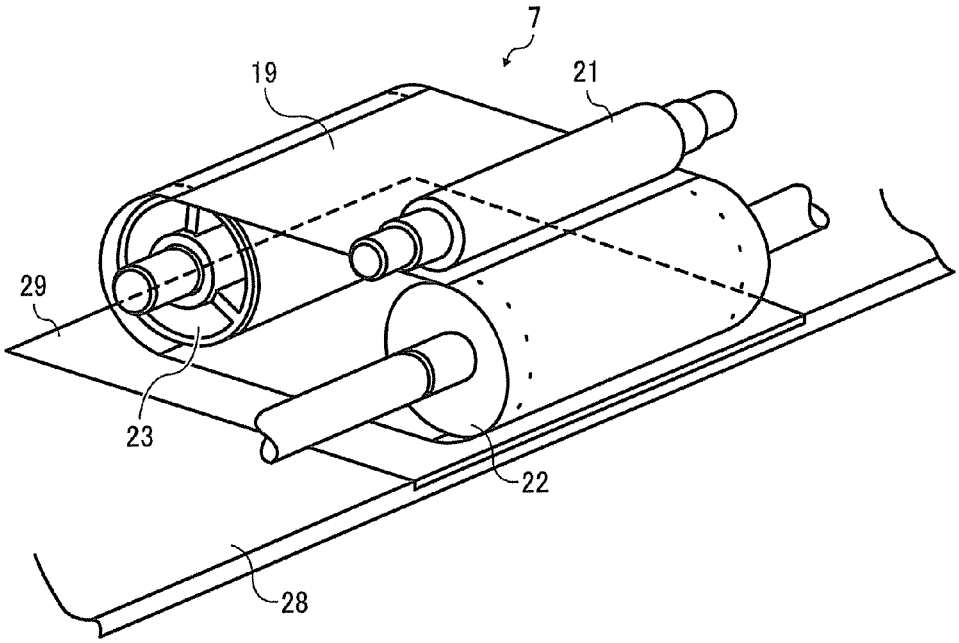
FIG. 2 is a perspective view of a sheet attracting and separating device used in the image forming apparatus.
Figure 3:
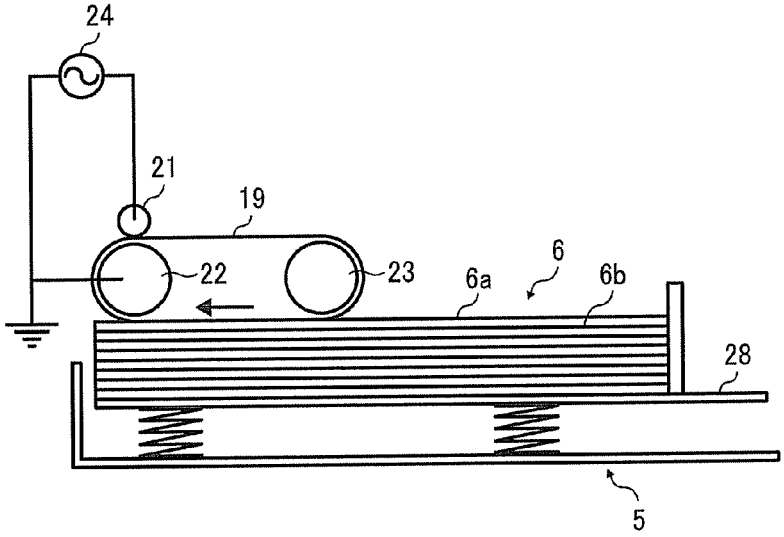
FIG. 3 is a conceptual side view of a sheet feeder used in the image forming apparatus.

FIG. 2 is a perspective view of the sheet attracting and separating device 7 used in the image forming apparatus according to the first embodiment. FIG. 3 is a conceptual side view of the sheet feeder 5 used in the image forming apparatus. The sheet attracting and separating device 7 includes an endless belt 19 made of a dielectric material and passing over a downstream roller 22 and an upstream roller 23. The endless belt 19 is made of a dielectric material having a resistance of approximately $10^8$ Ω·cm (ohm centimeters) or more, such as a film made of, for example, polyethylene terephthalate having a thickness of approximately 100 μm. In FIG. 2, the reference numerals 21, 28, and 29 designate a charging electrode, a bottom plate, and an insulating sheet provided to the bottom plate 28, respectively. The insulating sheet 29 allows the bottom plate 28 to be made of metal and increased in rigidity, and allows reliable feeding of sheets up to and including the last sheet.

In the sheet attracting and separating device 7 according to the first embodiment, the endless belt 19 has a two-layer structure including an outer layer and an inner layer. The outer layer is a dielectric layer having a resistance of approximately $10^8$ Ω·cm or more. The inner layer is made of a conductive material having a resistance of approximately $10^6$ Ω·cm or less and formed on the inner side of the outer layer. The charging electrode 21 is allowed to use the inner layer of the endless belt 19 as a grounded opposite electrode, and thus may be provided at any position in contact with the outer circumferential surface of the dielectric belt 19. The sheet stack 6 is set to a position allowing the endless belt 19 to secure a sufficient attraction area. The outer circumferential surface of the downstream roller 22 is provided with a coating of conductive rubber layer having a resistance of approximately $10^6$ Ω·cm. The upstream roller 23 is a metal roller. The downstream roller 22 and the upstream roller 23 are both electrically grounded.

An alternating current (hereinafter referred to as AC) power supply 24 in FIG. 3 may provide, as well as an AC voltage, a direct current (hereinafter referred to as DC) voltage alternating between high and low potentials. In the present embodiment, an AC voltage having an amplitude of approximately 4 kV (kilovolts) is applied to the outer circumferential surface of the endless belt 19.

In the thus-configured sheet attracting and separating device 7, the endless belt 19 formed with charge patterns is in contact with a front end portion of the upper surface of the uppermost sheet 6*a* on the sheet stack 6 at the position at which the endless belt 19 is wound around the upstream roller 23. Therefore, the Maxwell stress acts on the uppermost sheet 6*a*, which is a dielectric material, owing to a non-uniform electric field generated by the charge patterns formed on the outer circumferential surface of the endless belt 19. As a result, only the uppermost sheet 6*a* is attracted to and held by the endless belt 19, fed in the sheet feeding direction, and conveyed to the image forming unit 3 by the registration roller pair 11. Sheet attraction force generated by the charge patterns acts on a second sheet 6*b* and the subsequent sheets for a certain time period after the moment of attraction of the uppermost sheet 6*a*. After the lapse of the certain time period, however, the sheet attraction force acts only on the uppermost sheet 6*a*, and no longer acts on the second sheet 6*b* and the subsequent sheets. Therefore, the sheet attracting and separating device 7 kept standing by for a sufficient time period is capable of separating a sheet from the sheet stack 6 without the need for an additional blocking member.

When the downstream roller 22 and the upstream roller 23 are rotated in accordance with a sheet feeding signal, the endless belt 19 is driven. The endless belt 19 having started to rotate is supplied with an alternating voltage via the charging electrode 21 from the AC power supply 24. Thereby, charge patterns alternating at a pitch that is dependent upon the frequency of the AC power supply 24 and the rotation speed of the endless belt 19 are formed on the outer circumferential surface of the endless belt 19. Preferably, the pitch is set to approximately 5 mm to approximately 15 mm.

The registration roller pair 11 and the endless belt 19 are set to the same linear velocity. If the registration roller pair 11 is intermittently driven to adjust the timing of registration, the endless belt 19 is also intermittently driven. The endless belt 19 is separated from the sheet stack 6 before the rear end of the uppermost sheet 6*a* reaches a position facing the upstream roller 23 to prevent the second sheet 6*b* from being attracted to the endless belt 19.

Figure 4:
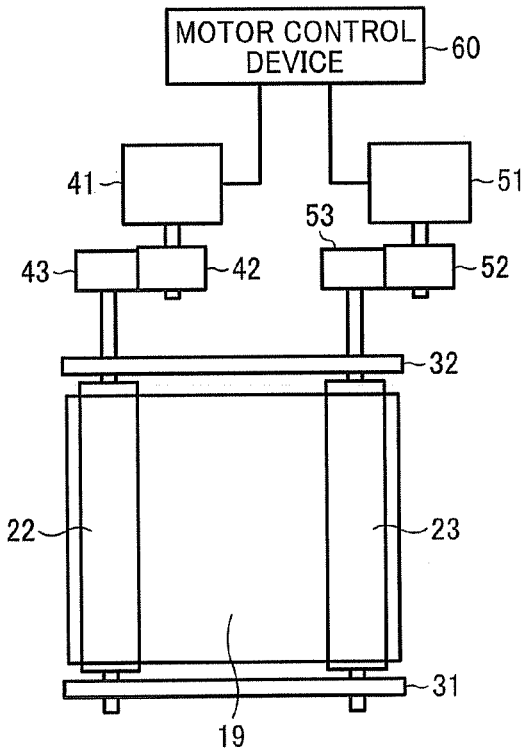
FIG. 4 is a conceptual plan view of the sheet attracting and separating device.

A driving operation of the sheet involving attracting and separating device 7 will now be described. FIG. 4 is a conceptual plan view of the sheet attracting and separating device 7 according to the first embodiment. In the sheet attracting and separating device 7 according to the first embodiment, the downstream roller 22 and the upstream roller 23 are rotatably supported by frame arms 31 and 32. Further, a pinion 42 is connected to a downstream motor 41, and a drive gear 43 is connected to the downstream roller 22. Thereby, rotational drive force of the downstream motor 41 is transmitted to the downstream roller 22 by the pinion 42 and the drive gear 43. Similarly, a pinion 52 is connected to an upstream motor 51, and a drive gear 53 is connected to the upstream roller 23. Thereby, rotational drive force of the upstream motor 51 is transmitted to the upstream roller 23 by the pinion 52 and the drive gear 53. Accordingly, the downstream roller 22 and the upstream roller 23 are driven by the downstream motor 41 and the upstream motor 51, respectively.

The downstream motor 41 and the upstream motor 51 are connected to a motor control device 60, and are separately controlled by the motor control device 60. A known control device, such as a sequencer, may be used as the motor control device 60.

In the first embodiment, the motor control device 60 controls the timing of driving the downstream motor 41 and the upstream motor 51, and thereby controls the endless belt 19 to be favorably stretched taut with tension in both the sheet attraction and the sheet conveyance.

Figure 5:
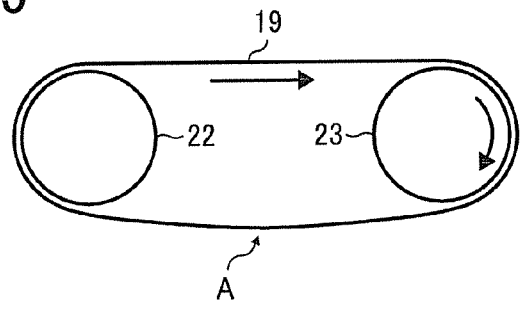
FIG. 5 is a schematic view illustrating a state of an endless belt in sheet attraction.
Figure 6:
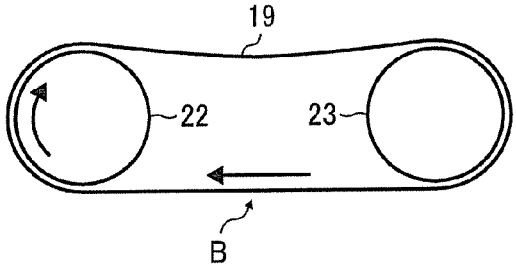
FIG. 6 is a schematic view illustrating a state of the endless belt in sheet conveyance.

Herein, a description will be given of the respective states of the endless belt 19 during the sheet attraction and the sheet conveyance. FIG. 5 is a schematic view illustrating the state of the endless belt 19 during the sheet attraction. FIG. 6 is a schematic view illustrating the state of the endless belt 19 during the sheet conveyance. As illustrated in FIG. 5, during the sheet attraction, a side of the endless belt 19 forming a sheet contact surface, which is indicated by the reference sign A in the drawing, sags and is slack, to increase the attraction area and improve the sheet separation performance. Thus, in this state, the surface of the endless belt 19 for attracting a sheet is slack and the sheet contact surface of the endless belt 19 is increased. Accordingly, the attraction force is increased, and the sheet separating operation is favorably performed.

By contrast, as illustrated in FIG. 6, after the sheet attraction, the side of the endless belt 19 forming the sheet contact surface, which is indicated by the reference sign B in the drawing, is applied with tension to be stretched into a substantially flat surface. Thereby, the sheet conveyance performance is improved. Further, during the sheet conveyance, the flatness of the endless belt 19 is improved, and the sheet conveyance performance is further improved.

Figure 7:
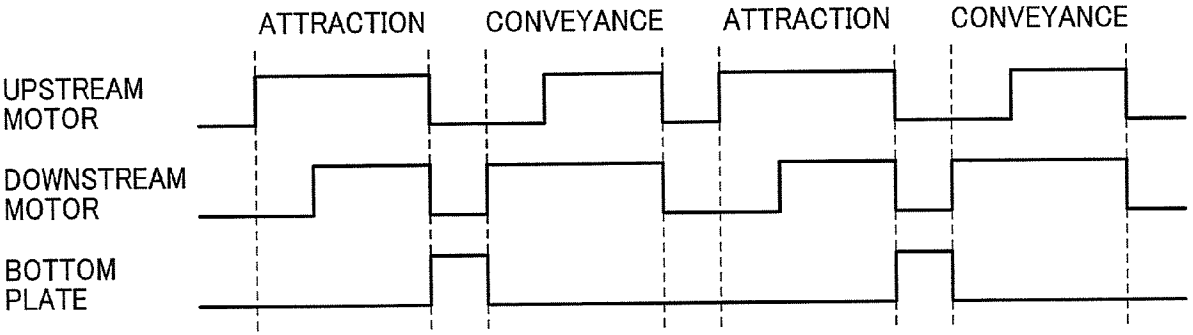
FIG. 7 is a timing chart illustrating a motor control of the sheet attracting and separating device.

Motor control device 60 control will now be described. In the first embodiment, the motor control device 60 shifts the operation time of the downstream roller 22 and the operation time of the upstream roller 23 from each other, to thereby improve the sheet separation performance and the sheet conveyance performance of the endless belt 19. FIG. 7 is a timing chart illustrating a motor control of the sheet attracting and separating device 7 according to the first embodiment. As illustrated in FIG. 7, the motor control device 60 shifts the drive start time of the downstream motor 41 and the drive start time of the upstream motor 51 from each other. That is, during sheet attraction, the motor control device 60 activates the downstream motor 41 later than the upstream motor 51, to thereby stretch the upper side of the endless belt 19 with tension and cause the lower side of the endless belt 19 to sag, as illustrated in FIG. 5. Meanwhile, during the sheet conveyance, the motor control device 60 activates the upstream motor 51 later than the downstream motor 41, to thereby stretch the lower side of the endless belt 19 with tension and cause the upper side of the endless belt 19 to go slack, as illustrated in FIG. 6. With this control, the endless belt 19 is placed in a favorable state both during the sheet attraction and the sheet conveyance.

According to the first embodiment, during sheet attraction, the sheet contact surface of the endless belt 19 is slack to place the endless belt 19 in a state suitable for the sheet attraction. Further, during sheet conveyance, the sheet contact surface of the endless belt 19 is applied with tension and stretched into a substantially flat surface to place the endless belt 19 in a state suitable for the sheet conveyance. Accordingly, the sheet separation and conveyance is stably performed.

Figure 8:
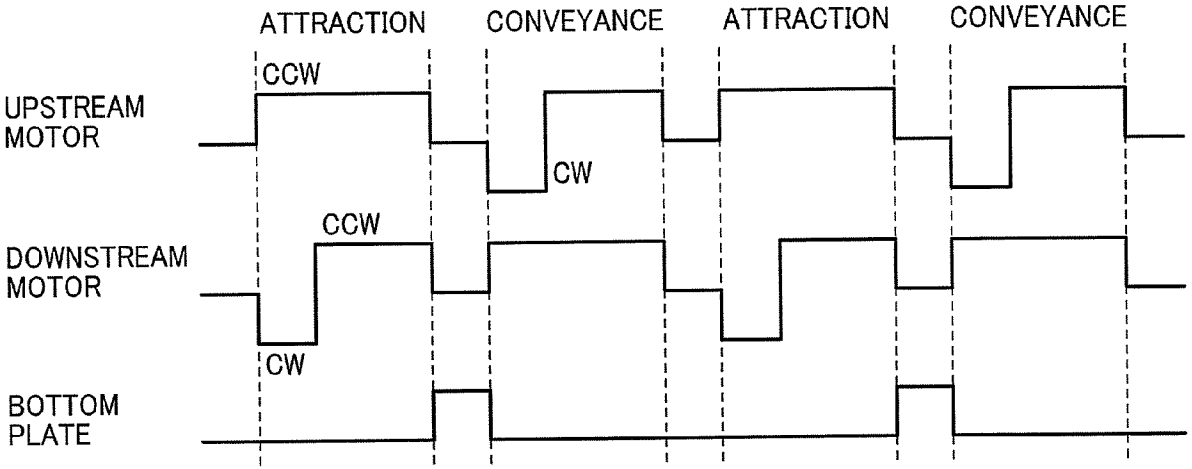
FIG. 8 is a timing chart illustrating a motor control of a sheet attracting and separating device according to a second embodiment.

A description will be now given of a sheet attracting and separating device according to a second embodiment. In the second embodiment, the motor control device 60 performs a forward and reverse control when activating the downstream motor 41 and the upstream motor 51, to thereby cause the endless belt 19 to sag as in the first embodiment. FIG. 8 is a timing chart illustrating motor control of the sheet attracting and separating device according to the second embodiment. During sheet attraction, the motor control device 60 drives the upstream motor 51 in the forward direction, which corresponds to the counterclockwise (hereinafter referred to as CCW) direction. At the same time, the motor control device 60 temporarily drives the downstream motor 41 in the reverse direction, which corresponds to the clockwise (hereinafter referred to as CW) direction, and thereafter drives the downstream motor 41 in the forward direction, i.e., the CCW direction. By contrast, during sheet conveyance, the motor control device 60 drives the downstream motor 41 in the forward direction, i.e., the CCW direction. At the same time, the motor control device 60 temporarily drives the upstream motor 51 in the reverse direction, i.e., the CW direction, and thereafter drives the upstream motor 51 in the forward direction, i.e., the CCW direction.

Also in the second embodiment, the sheet contact surface of the endless belt 19 is slackened during sheet attraction to place the endless belt 19 in a state suitable for the sheet attraction, and the sheet contact surface of the endless belt 19 is stretched taut into a substantially flat surface during sheet conveyance to place the endless belt 19 in a state suitable for the sheet conveyance. Accordingly, the sheet separation and conveyance is stably performed.

Figure 9A:
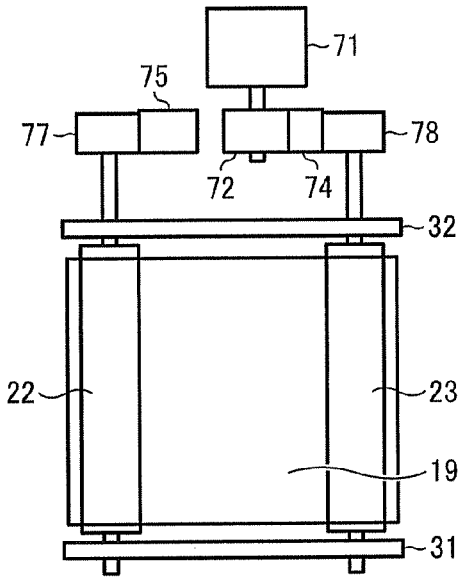
FIGS. 9A to 9E are diagrams illustrating a sheet attracting and separating device according to a third embodiment, FIGS. 9A and 9B illustrating schematic plain views, FIGS. 9C and 9D illustrating schematic front views, and FIG. 9E illustrating a timing chart.
Figure 9B:
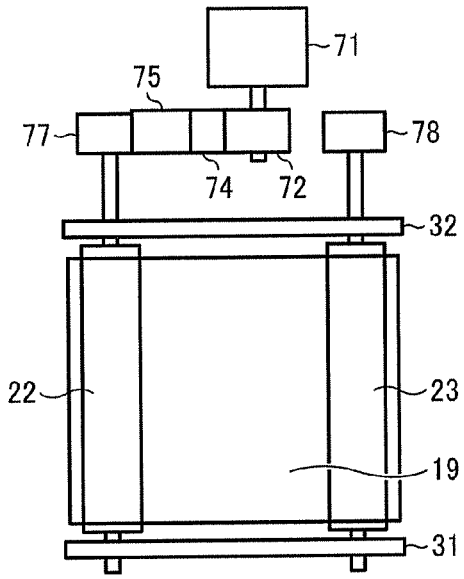
Figure 9C:
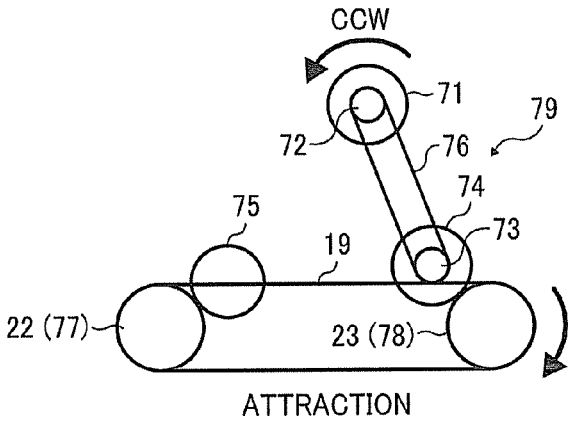
Figure 9D:
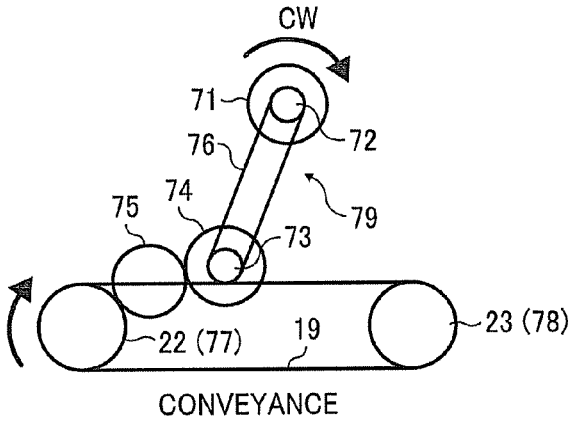
Figure 9E:
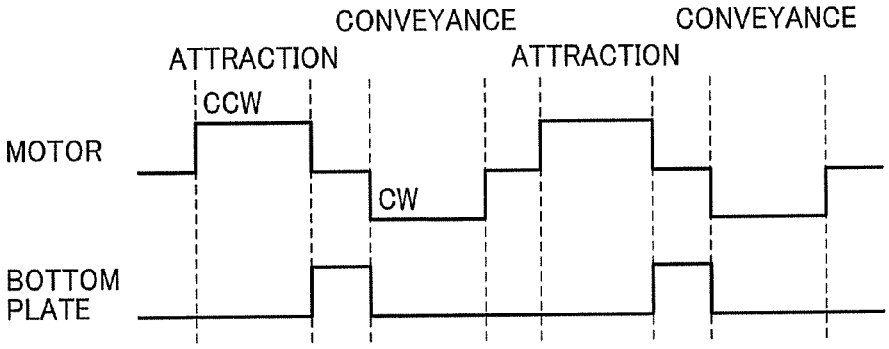

A description will now be given of a sheet attracting and separating device according to a third embodiment. In the third embodiment, the downstream roller 22 and the upstream roller 23 are driven by a single motor serving as a common drive source. FIGS. 9A to 9E illustrate the sheet attracting and separating device according to the third embodiment. FIGS. 9A and 9B are schematic plan views. FIGS. 9C and 9D are schematic front views. FIG. 9E is a timing chart.

In the third embodiment, as illustrated in FIGS. 9A to 9D, a motor 71 is connected to a drive force transmission mechanism 79 swingably configured by a mechanism having a belt 76 wound around pulleys 72 and 73. Thereby, drive force of the motor 71 is transmitted to a swing gear 74 coaxial with the pulley 73. Further, the upstream roller 23 is connected to an upstream drive gear 78, and the downstream roller 22 is connected to a downstream drive gear 77 and an idler gear 75.

The drive force transmission mechanism 79 is swung by a known swing device, such as a motor, an electromagnetic solenoid, or a hydraulic mechanism. Thereby, the swing gear 74 is caused to selectively mesh with the idler gear 75 and the upstream drive gear 78 to drive the downstream roller 22 and the upstream roller 23, respectively. In other words, the drive force transmission mechanism 79 can be swung between a position illustrated in FIG. 9A and a position illustrated in FIG. 9B by switching the directions according to rotation of the motor 71 only, and alternatively may be swung by at least one of an additional motor, an electromagnetic solenoid, and a hydraulic mechanism. At the same time, the motor 71 is run in forward and reverse, as illustrated in FIG. 9E. Thereby, the upstream roller 23 is driven during sheet attraction, as illustrated in FIG. 9C. During sheet conveyance, the motor 71 is driven in the reverse direction to drive the downstream roller 22, as illustrated in FIG. 9D.

According to the third embodiment having the above-described configuration, during sheet attraction, the upstream roller 23 is driven to rotate, and the downstream roller 22 is rotated in accordance with the rotation of the upstream roller 23. Thereby, the sheet contact surface on the lower side of the endless belt 19 is slack, and the endless belt 19 is placed in a state suitable for the sheet attraction, as illustrated in FIG. 5.

By contrast, during sheet conveyance, the downstream roller 22 is driven to rotate, and the upstream roller 23 is rotated in accordance with the rotation of the downstream roller 22. Thereby, the sheet contact surface on the lower side of the endless belt 19 is applied with tension and stretched into a substantially flat surface, and the endless belt 19 is placed in a state suitable for the sheet conveyance, as illustrated in FIG. 6. According to the third embodiment, the sheet separation and conveyance is stably performed by the sheet attracting and separating device employing the single drive source.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A sheet feeder that attracts an uppermost sheet of a sheet stack of a plurality of stacked sheets and feeds the uppermost sheet in a sheet feeding direction, the sheet feeder comprising:

an endless belt made of a dielectric material, entrained around an upstream roller and a downstream roller and disposed above the sheet stack to face the sheet stack;

a charging device configured to apply an alternating voltage to an outer circumferential surface of the endless belt to form thereon an alternating charge pattern; and a control device configured to separately control rotation of the upstream roller and the rotation state of the downstream roller to make the endless belt go slack on a side of belt facing the sheet stack during sheet attraction and make the endless belt taut with tension on a side of the belt facing the sheet stack to form a substantially flat surface during sheet conveyance.

2. The sheet feeder according to claim 1, further comprising:

an upstream drive source configured to drive the upstream roller; and a downstream drive source configured to drive the downstream roller, wherein the control device controls the timing of driving of the upstream drive source and the downstream drive source separately during sheet attraction and sheet conveyance.

3. The sheet feeder according to claim 1, further comprising:

an upstream drive source configured to drive the upstream roller; and a downstream drive source configured to drive the downstream roller, wherein the control device switches between forward drive and reverse drive of the upstream drive source and the downstream drive source during sheet attraction and sheet conveyance.

4. The sheet feeder according to claim 1, further comprising:

a single drive source configured to drive the upstream roller and the downstream roller, wherein the control device includes a switching mechanism configured to switch between the upstream roller and the downstream roller as the transmission destination of rotational drive force of the drive source.

5. An image forming apparatus comprising:

an image forming device configured to form an image on a sheet; and the sheet feeder according to claim 1.

* * * * *